United States Patent [19]

Pattison

[11] Patent Number: 4,991,852

[45] Date of Patent: Feb. 12, 1991

[54] MULTI-PURPOSE GOLF BALL

[76] Inventor: John W. Pattison, 7007 Pine Vista, Houston, Tex. 77092

[21] Appl. No.: 345,166

[22] Filed: Apr. 28, 1989

[51] Int. Cl.[5] ..... A63B 37/14
[52] U.S. Cl. ..... 273/232; 40/327
[58] Field of Search ..... 273/232; 40/327

[56] References Cited

U.S. PATENT DOCUMENTS

| | | | |
|---|---|---|---|
| 878,254 | 2/1908 | Taylor | 273/232 |
| 4,346,898 | 8/1982 | Badke | 273/232 |

FOREIGN PATENT DOCUMENTS

| | | | |
|---|---|---|---|
| 1005480 | 2/1977 | Canada | 273/232 |
| 377354 | 7/1932 | United Kingdom | 273/232 |
| 2156687 | 10/1985 | United Kingdom | 273/232 |

*Primary Examiner*—George J. Marlo
*Attorney, Agent, or Firm*—Kenneth A. Roddy

[57] ABSTRACT

A multi-purpose golf ball having 812 concave hexagonal surface depressions arranged in a uniformly arranged geodesic nine-frequency icosahedral pattern over the surface of the ball and each depression having a surface diameter in the range of from 0.090 inches to 0.140 inches and a depth in the range of from 0.002 inches to 0.014 inches.

1 Claim, 2 Drawing Sheets

MULTI-PURPOSE GOLF BALL

BACKGROUND OF THE INVENTION

1. Field of the Invention

This invention relates generally to golf balls, and more particularly to a multi-purpose golf ball having a large number of dimples of predetermined size and shape arranged in a dimple pattern to impart more accurate putting and flight characteristics.

2. Brief Description of the Prior Art

Golf balls are designed with individual depressions, or dimples, in the surface of the ball. The dimple or depression pattern and the depth and width of the dimples are designed to aerodynamically assist the travel distance and accuracy of the golf ball flight.

Conventional golf balls are formed with from 384 to 492 dimples, or concave depressions, in the surface of the ball. Conventional golf balls also utilize various dimple patterns such as; icosahedral (20 triangles), octahedral (8 triangles), dodecahedral (12 pentagons), double-dimple triangular design, icosahedral multiple parting line (12 pentagons within 20 triangles, and an interlock (80 small triangles within 20 large triangles).

These same conventional balls are used in both putting and driving strokes, and often a ball which has superior flight characteristics will have inferior putting characteristics. It would therefore be desirable to provide a multi-purpose golf ball having the optimum dimple pattern and also having dimples of the optimum width and depth for both putting accuracy and for driving distance and accuracy.

Suitable putting and driving tests with conventional golf balls having these conventional dimple patterns and having dimples of conventional diameter and depth have shown both putting and driving inaccuracies with resultant angular deviation of the ball line of motion (direction) relative to the club head line of motion (direction).

Tests have also shown that the inaccuracy, or angle of deviation, of the resultant putted or driven ball motion (direction) relative to the club line of motion (direction) is greater with a decrease of the club head force applied to the ball.

Suitable test equipment was developed and used for these putting and driving tests. A simple observation test can be performed by dropping a golf ball onto a level, smooth surface plate, and observing the angle of deviation of the ball return bounce from the vertical fall line of the dropped ball.

The surface of the ball is compressive. The compressive resistance area of contact of the ball from the club's force is proportional in size to the club force applied. In other words, when the force of the club is decreased, the size of the club-to-ball contact surface area is also decreased.

A low club compression force into the golf ball surface will produce a small area of ball surface resistance to the club contact force. The center of resistance of this small ball surface contact area can fall on the extreme edge of the depression, or dimple, of the ball, which can also be circumferentially offset from the center line of the stroke or swing direction relative to the center of the ball mass which will produce an inaccuracy, or deviation, of the resultant line of ball motion direction from the club's line of motion direction.

A greater club compression force into the golf ball surface will produce a larger area of ball surface resistance to the club contact force. The center of resistance of this larger ball surface contact area can result in compression of more of the edge of the depression, or dimple, of the ball, which will locate the center of the area of compression resistance more toward the center line of the stroke or swing direction relative to the center of the ball mass which will produce a smaller inaccuracy, or angle of deviation, of the resultant line of ball motion direction from the club's line of motion direction.

In accordance with Newton's Second Law of Motion, an unbalanced force acting on a body causes an acceleration of the body in the direction of the force of magnitude proportional to the force and inversely to the mass of the body. It is nearly impossible for a golf player to position a golf ball so that the club will accurately strike the depressions, or dimples, of the ball in balance with the club line of direction through the center of the ball. Thus the most likely result will be a deviation of the ball relative to the line of the stroke.

The patent to Badke, U.S. Pat. No. 4,346,898 (which is licensed to applicant) discloses a putting golf ball having concave depressions of from 0.08" to 0.02" surface diameter, and from 0.002" to 0.014" depth which cover from 20% to 90% of the surface of the ball. The size and depth of the dimples of this putting ball has proven to reduce the deviation in the putting game. However, the present invention is a significant improvement over the Badke patent as explained hereinafter.

The present invention is distinguished over the prior art in general, and the Badke patent in particular by a multi-purpose golf ball having 812 concave hexagonal surface depressions arranged in a regular geodesic nine-frequency icosahedral pattern over the surface of the ball and each depression having a surface diameter in the range of from 0.090 inches to 0.140 inches and a depth in the range of from 0.002 inches to 0.014 inches.

SUMMARY OF THE INVENTION

It is therefore an object of the present invention to provide a multi-purpose golf ball having the optimum dimple pattern and also having dimples of the optimum width and depth for both putting accuracy and for driving distance and accuracy.

It is another object of this invention to provide a multi-purpose golf ball which will more accurately and consistantly position the club force to the ball surface contact area center point of resistance in line with the stroke direction to the center of mass of the ball.

Another object of this invention is to provide a multi-purpose golf ball having a relatively large number of dimples of optimum width and depth for both putting accuracy and for driving distance and accuracy and which will conform the standards of the United States Golf Association for weight, size, symmetry, initial velocity, and overall distance.

A further object of this invention is to provide a multi-purpose golf ball having a relatively large number of dimples of optimum width and depth which will reduce the deviation of the ball flight path relative to the center line of the club swing path, resulting in more accuracy in putting and driving with very little loss in ball travel distance.

A still further other object of this invention is to provide a multi-purpose golf ball having a plurality of dimples arranged in a nine-frequency icosahedral pattern over the surface of the ball.

Other objects of the invention will become apparent from time to time throughout the specification and claims as hereinafter related.

The above noted objects and other objects of the invention are accomplished by a multi-purpose golf ball having 812 concave hexagonal surface depressions arranged in a regular geodesic nine-frequency icosahedral pattern over the surface of the ball and each depression having a surface diameter in the range of from 0.090 inches to 0.140 inches and a depth in the range of from 0.002 inches to 0.014 inches.

DESCRIPTION OF THE PREFERRED EMBODIMENT

Figure 1:
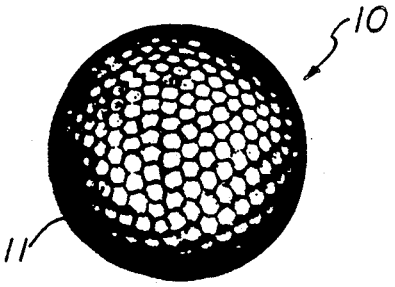
FIG. 1 is an elevation of the multi-purpose golf ball in accordance with the present invention.

Referring to the drawings by numerals of reference, there is shown in FIG. 1, a preferred multi-purpose golf ball 10. The multi-purpose golf ball 10 is a sphere which has a plurality of concave surface depressions, or dimples, 11 equally spaced over the ball surface. The ball 10 has an inner ball of elastomeric material which may be hollow center, solid center, liquid filled, and wrapped with elastic winding, as is well known in the art. The preferred center is formed of hard rubber polymer. The outer covering of the ball 10 is a tough polymeric material, also as known in the art. The preferred cover is formed of Surlyn plastic (Du Pont Co.).

The depressions, or dimples 11 may be stamped on the surface of the ball, or cast thereon, however, the preferred ball surface configuration is injection molded in two hemispheres and bonded together by conventional means to form the complete sphere.

Figure 2:
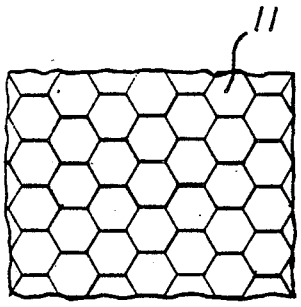
FIG. 2 (PRIOR ART)
FIG. 2 is an illustration of a portion of the cover of a conventional golf ball of the prior art projected in a flat plane.
Figure 3:
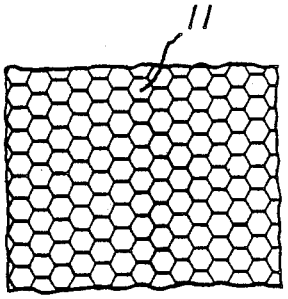
FIG. 3 is an illustration of a portion of the cover of the present multi-purpose golf ball projected in a flat plane.

As shown in FIGS. 2 and 3, the conventional golf ball of the prior art (FIG. 2) has a plurality of dimples, however, they are much larger in diameter and deeper than those of the present invention (FIG. 3). Conventional golf balls are formed with from 384 to 492 dimples. FIG. 2 illustrates a conventional golf ball having 384 dimples. The surface diameter of the dimples of conventional golf balls is much larger than that of the present invention.

As seen in FIG. 3, the present golf ball 10 has 812 small dimples equally spaced over the surface of the ball. However, it should be understood that the number may range from 500 to 900 dimples, and may cover from 20% to 90% of the surface area of the ball.

Figure 4:
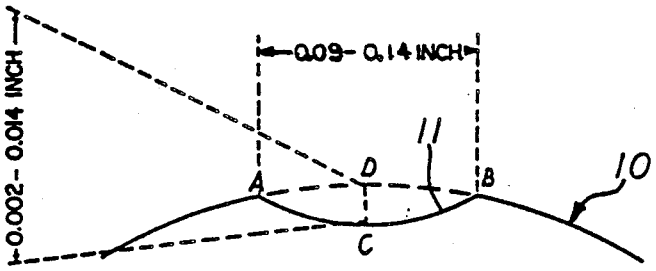
FIG. 4 is an enlarged cross sectional view of one depression of the present golf ball.

Referring now to FIG. 4, the depressions or dimples of the present golf ball 10 have a surface diameter in the range of from 0.090 inches to 0.140 inches, and may be round, square, octagon, or hexagon. A hexagonal shaped dimple having sloped sides is preferred, with the diameter in the stated range being measured across the flats AB and having a depth CD of not less than 0.002 inch or greater than 0.014 inch.

Conventional golf balls utilize various dimple patterns such as; icosahedral (20 triangles), octahedral (8 triangles), dodecahedral (12 pentagons), double-dimple triangular design, icosahedral multiple parting line (12 pentagons within 20 triangles, and an interlock (80 small triangles within 20 large triangles).

Figure 5:
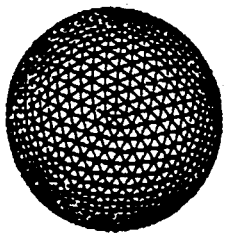
FIG. 5 is a schematic illustration of a sphere divided into a regular geodesic nine-frequency icosahedron.

The dimples of the present ball 10 are arranged in a geodesic icosahedral pattern over the surface of the ball, and more particularly, in a pattern known as a geodesic nine-frequency icosahedral pattern (FIG. 5). It has been determined through testing that the most accurate multi-purpose golf ball is produced with a combination of 812 concave hexagonal surface depressions arranged in a regular geodesic nine-frequency icosahedral pattern over the surface of the ball and each depression having a surface diameter in the range of from 0.090 inches to 0.140 inches and a depth in the range of from 0.002 inches to 0.014 inches.

Figure 6:
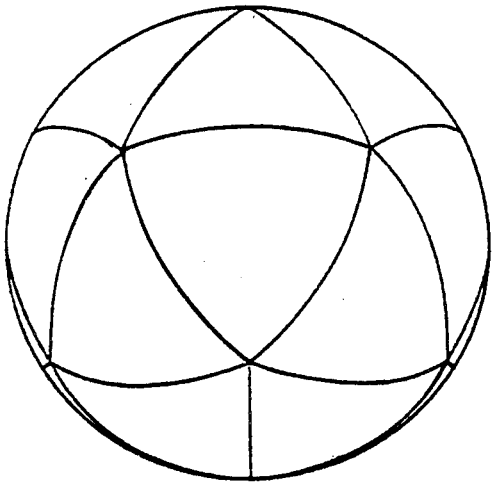
FIG. 6 is a diagramatic illustration of a sphere divided into twenty main triangles based on an inscribed icosahedron pattern.
Figure 7:
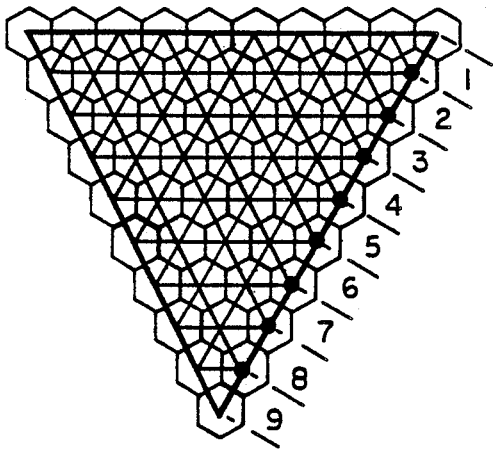
FIG. 7 illustrates one of the twenty main icosahedral triangles having each side divided into nine parts to produce a total of 812 vertices uniformly distributed over the entire spherical surface of the ball.

In other words, as illustrated in FIGS. 6 and 7, there are twenty (icosahedral) main triangles, only one of which is shown in FIG. 7, and each side of each main triangle is divided into nine parts 1–9 (hence nine-frequency). The division points are connected by lines to form a series of intersecting vertices to produce a total of 812 vertices uniformly distributed over the entire surface of the sphere in accordance with known principles of mathmatics. Each of the dimples is preferrably centered on each of the vertices intersections. The term "geodesic" pertains to the geometry of curved surfaces, wherein the lines of the triangles are actually curved lines rather than straight lines, as would be the case in plane geometry. However, for purposes of illustration and ease of understanding the lines of FIG. 7 are represented as straight lines.

To investigate the putting and driving characteristics of the present golf ball, apparatus was devised to provide constant and reproducible club swings. Briefly, the putting apparatus comprised a vertical frame with a hinged putter component mounted therein. The putter component was a pair of rigid members, shafts affixed to a plate at the top, which was pivotally mounted on the frame, and a smooth metal plate at the lower end which served as the putter head.

The length of the stroke of the putter head was adjusted by an adjustable bracket against which the putter head was seated and held on the rearward stroke. The putter head was held in place by an electromagnet, which when deactivated, freed the putter to swing forward and strike the ball. The force applied on each swing was that of gravity at the particular bracket position.

The golf balls were positioned in a small O-ring attached to a horizontal, smooth glass, putting surface. A smooth steel plate was positioned a fixed distance from the O-ring on the putting surface perpendicular to the putter stroke line. A sheet of paper was placed over the plate facing the putter and a sheet of carbon paper was placed over the paper.

The evaluations were made by placing a particular golf ball in the O-ring and putting it a given back stroke a number of times. The putted ball would strike the carbon paper and mark the paper below.

It was determined that for any given golf ball, the longer the stroke, i.e., greater compressive force, a smaller deviation in the path of the ball from the line of the stroke was obtained. The ball path variation observed at any stroke length was found to be proportional to the surface diameter of the depressions, or dimples, of the ball.

It has been calculated for various surface diameters that the maximum deviation of a putted ball and a minimum stroke force to propel the ball 3 feet would be:

| SURFACE DIAMETER or WIDTH of DEPRESSION (average) Inches | MAXIMUM DEVIATION AT 3 FEET (RIGHT OR LEFT FROM LINE OF STROKE) |
|---|---|
| 0.020 | 0.42 |
| 0.080 | 1.71 |
| 0.106 | 2.27 |
| 0.110 | 2.35 |
| 0.120 | 2.57 |
| 0.125 | 2.65 |
| 0.135 | 2.87 |
| 0.140 | 3.00 |
| 0.150 | 3.21 |

To investigate the driving characteristics of the present golf ball, testing was conducted by Golf Laboratories in San Diego, California. Conventional testing apparatus was used to provide constant and reproducible club swings. Several conventional golf balls were tested with three variations of the present golf ball. All balls had a compression rating of 100.

The conventional balls tested were a Spalding Top-Flite XT having 332 dimples, an Acushnet Pinnacle having 384 dimples, and a Wilson Ultra having 432 dimples. The balls of the present invention, designated by X-1, X-2, and X-3, all had 812 hexagonal dimples and X-1 had a dimple diameter of 0.11", X-2 had a dimple diameter of 0.09", and X-3 had a dimple diameter of 0.07".

The evaluations were made by driving each ball and measuring the distance from the tee to the point where the ball landed (Drive). The deviation (Dispersion) to the right or left of the center line of the path was measured at the touch-down point of each ball. After the ball finished rolling, the distance from the tee to the resting place of the ball was measured (TTL Distance). The deviation (Dispersion) to the right or left of the center line of the path was measured at the point where each ball came to rest after rolling (TTL Dispersion).

These tests were repeated numerous times, and the average measurements were obtained:

| No. of Dimples Dia. of Dimples | Top-Flite (332) | Pinnacle (384) | Ultra (432) | X-1 (812) (.11) | X-2 (812) (.09) | X-3 (812) (.07) |
|---|---|---|---|---|---|---|
| Av. Drive (yd) | 251 | 239 | 247 | 196 | 222 | 224 |
| Av. Dispersion | 5'-R | 7'-R | 16'-R | 9'-L | 1'-L | 1'-R |
| TTL Distance | 274 | 275 | 281 | 230 | 260 | 248 |
| TTL Dispersion | 2'-R | 1'-L | 32'-R | 10'-L | 2'-R | 7'-R |

It was shown that the balls of the present invention having 812 dimples would fly slightly lower and have less spin than the conventional balls having fewer dimples, and that the present balls X-2 and X-3 having a dimple diameter of 0.07" and 0.09" had the least deviation (Dispersion) at the touch-down point than any of the conventional balls (only one-foot from centerline). The present ball X-2 having a dimple diameter of 0.09" also had the least deviation after coming to rest after rolling (only two-feet from centerline). This same ball X-2 also had the greatest total distance of the balls of the present type. The X-2 ball was only about 20 yards short of the conventional ball having the greatest total distance, but the X-2 ball was more accurate.

Thus, the present golf ball makes a very accurate multi-purpose ball with a small sacrifice in total distance, which results in reducing the amount of hook and slice spin.

While this invention has been described fully and completely with special emphasis upon a preferred embodiment, it should be understood that within the scope of the appended claims the invention may be practiced otherwise than as specifically described herein.

I claim:

1. A multi-purpose golf ball having 812 concave hexagonal surface depressions uniformly arranged over the surface thereof, each of said hexagonal depressions having a surface diameter in the range of from 0.090 inches to 0.140 inches and having a depth in the range of from 0.002 inches to 0.014 inches, said 812 hexagonal depressions being uniformly arranged over the surface of the ball in a nine frequency geodesic or curved icosahedral pattern defined by twenty main triangles with each side of each main triangle divided into nine parts to form a total of 812 intersecting vertices uniformly distributed over the entire surface of the ball, and each of said depressions being centered on the point of intersection of each of the vertices.

* * * * *